US006435426B1

(12) United States Patent
Copp, Jr.

(10) Patent No.: US 6,435,426 B1
(45) Date of Patent: Aug. 20, 2002

(54) FLOATING GASKET PLATE FOR PAINT CUP ON SPRAY GUN

(76) Inventor: William H. Copp, Jr., 117 Davis Rd., Bedford, MA (US) 01730

( * ) Notice: Subject to any disclaimer, the term of this patent is extended or adjusted under 35 U.S.C. 154(b) by 0 days.

(21) Appl. No.: 09/568,765

(22) Filed: May 11, 2000

Related U.S. Application Data

(60) Provisional application No. 60/133,615, filed on May 11, 1999.

(51) Int. Cl.[7] ..... B05B 7/30

(52) U.S. Cl. ..... 239/346; 239/345; 239/347; 239/373; 239/377; 215/349; 220/303; 220/304

(58) Field of Search ..... 220/303, 304, 220/916, 378; 215/347, 349; 239/340, 345, 346, 347, 351, 354, 364–366, 368, 369, 373, 376, 377, 379

(56) References Cited

U.S. PATENT DOCUMENTS 3,236,459 A * 2/1966 McRitchie
3,888,347 A * 6/1975 Kramer ..... 220/303
4,285,440 A * 8/1981 Adams ..... 220/303
4,805,443 A * 2/1989 Schroeder ..... 220/303
5,582,350 A 12/1996 Kosmyna et al.

* cited by examiner

*Primary Examiner*—William C. Doerrler
*Assistant Examiner*—Christopher Kim
(74) *Attorney, Agent, or Firm*—Vernon C. Maine; Scott J. Asmus; Maine & Asmus

(57) ABSTRACT

A pressure proof gasket plate for use with a cup and special or modified lid assembly for a spray gun, consisting of a cup with a first end configured with fittings suitable for attachment to the feed port of the spray gun and a second end with a large opening for access and filling, and a domed lid, with an external mechanism for providing a compressive attachment of the lid to the cup with the gasket plate in between. The floating gasket plate has a compressible gasket configured on its inside surface so as to form a seal when it contacts the edge of the cup as the lid is applied to the cup. The floating gasket plate is sealed to the cup by pressure on its periphery as applied by the domed lid. The floating gasket plate is made of such material and thickness as to resist deflection and deformation under normal working pressure of the spray gun.

5 Claims, 2 Drawing Sheets

FLOATING GASKET PLATE FOR PAINT CUP ON SPRAY GUN

This application relates and claims priority to pending U.S. application Ser. No. 60/133,615, filed May 11, 1999 by the same inventor.

BACKGROUND OF THE INVENTION

1. Technical Field of the Invention

This invention most generally relates to the application of paints and other materials by spraying from a spray gun configured with a top mount feed cup, and in particular, it relates to a top mount feed cup with a pressure proof gasket plate and adapter fitting.

2. Background Art

The art of spray painting of paints and other liquid materials using a handheld spray gun with a nozzle from which the liquid material is emitted in a stream or an atomized spray directed towards the target, is well established. A relatively low viscosity fluid mixture of desired material is most often supplied through the gun to the nozzle from a remote container and hose, or a feed cup attached to the underside or top side of the spray gun body. Depending on the system, the fluid may be supplied through the gun body to nozzle by gravity feed, siphoning or pumping action, or by pressure applied to the liquid reservoir to push the liquid into the gun.

Top feed cups are used in both pressurized and non-pressurized systems. The cups and lids, which are typically fabricated of plastic or metal, must be impervious to the methylene chloride and other active ingredients in the paint strippers and solvents that are used for cleaning and maintaining this type of equipment.

The top feed cups of hand held spray guns typically have a funnel-shaped bottom with a threaded nipple for screw-on attachment to the barrel of the gun. Exterior threads at the top of the cup wall accept a full diameter threaded dome cap or lid with a vent, pressure inlet, or check valve in the center. In use, the lid is screwed onto the filled cup, contacting and rotating along the top edge of the cup until increasing turning torque suggested a compressive seal has been attained. The check valve, where used, permits ingress of air but closes under pressure, as is needed for the on/off application of drive air in a turbine powered high volume, low pressure (HVLP) system or for retaining the pressure in a conversion gun. A simple, non-spill vent is used in gravity feed and suction systems.

Bottom feed cups have only a top opening, through which support, and access for filling and cleaning, as well as feed tube and venting or pressure is accomplished. The attachment fitting for a bottom feed cup is necessarily larger than for a top feed cup, due to the added size needed for filling and access.

The lid to cup seal in the typical, top cup, screw-on lid arrangement, is subjected to rotational contact and frictional wear while being compressed, contributing to poor sealing and deterioration of the seal surfaces. Elevated air pressure in the pressure cups of the prior art exerts a deforming stress on the sidewalls of the cup and on the entire inner surface area of the lid. The stress and related deformation tends to open the seal joint by leverage and distortion of the thread interface. The gun and cup are subjected to constant motion in use, and the reactive movement of the cup's contents assures that the liquid contacts the full circumference of the cup/lid juncture and inevitably works into any area along the perimeter that may be susceptible to leaking.

In fact, most top feed paint spray gun cups, both pressurized and non-pressurized, are notorious for leaking around the cap or lid, resulting in a mess on the operator's gun, hands, and often on the object being painted. There seems not to be any simple, lightweight, inexpensive means of reliably sealing these cups, particularly for pressurized systems where pressure is applied to the paint cup.

One prior art offering, directed at the leakage problem, " . . . designed either for gravity paint feed or, preferably, for suction feed in combination with gravity feed." (Col. 2, line 28), is disclosed in Kosmyna et al's U.S. Pat. No. 5,582,350; a hand held paint spray gun with top mounted paint cup. Here, the cup is configured with a tapered top edge rim, and with external locking knobs on the cup wall below the taper. The cup lid is configured with a V-groove that fits over the tapered edge of the cup rim, and a locking ring with external bayonet type structures that engage the locking knobs by partial rotation of the locking ring, to seal the lid to the cup.

This arrangement suggests, although does not explicitly recite, a non-rotating seal engagement, where the lock ring is rotable relative to the lid, eliminating the rotational friction at the seal between the cup and lid while the lid is being locked in place. However, this design was expressly intended for other than pressurized systems, and does not speak to or anticipate the problems that pressure introduces to the design. It also does not suggest a kit methodology for modifying or retrofitting an existing paint cup and lid assembly to obtain the alleged benefit of the design.

In summary, problems heretofore exhibited in the art of spray guns includes pressurized paint spray guns with top feed cup and lid assemblies that are unreliable in retaining paint without leaking during the course of the work.

SUMMARY OF THE INVENTION

The invention in its simplest form is a locking lid and floating gasket plate assembly for pressurized, top cup spray guns such as are commonly used for spraying small quantities of paint, and other fluids. In this form, the invention assumes a conventional top cup with external threads at the top of the cup wall for rotationally advancing attachment of a lid. At the core of the invention is a relatively stiff, flat, rigid, pressure proof, gasket plate intended to be secured to the top of the cup with a special lid. The domed lid here functions as an edge lock structure on the gasket plate, that is separate and distinct from the gasket plate, so as to be rotable as to the plate, and isolated from cup pressure so as to be not susceptible to deformation from cup pressure. The lid further functions as a full splatter shield, with a closely conforming center clearance hole for an adapter fitting in the gasket plate.

A vent, pressure feed or check valve fitting, according to the type of system in which the cup is employed, is connectable to the center mounted adapter fitting. The adapter fitting protrudes or is accessed through the closely fitting co-axial opening in the lid. The gasket plate is fabricated of flat stock for economy and simplicity of design, and forms a relatively rigid top to the pressure chamber within the cup. The adapter fitting in the plate replaces the fitting normally found mounted in the lid.

The floating gasket plate is slightly larger than the diameter of the cup rim. When the lid is screwed down on or otherwise compressively attached to the top of the cup with the gasket plate in between, the gasket plate forms a stationary, compressive, full ring seal on the cup rim and a pressure proof top to the paint cup. The gasket plate is designed and constructed of material sufficiently strong to contain the working pressure within the cup without deforming significantly, which aids in maintaining the integrity of the seal. The gasket plate is compressed at its periphery by the outer edge of the inside surface of the domed lid against the top edge of the cup as the lid is screwed onto the cup. There is no contact between the plate and the lid except at their peripheries. The lid is thereafter susceptible only to unidirectional lifting force vectors, and not to the stress and deformation caused by pressure across its entire surface.

The plate to cup seal is unaffected by rotational friction and distortion as the compression is applied, and is thus free of small or microscopic damage and wear caused by the rotating compressive engagement. The lid and the cup and lid threads are likewise isolated from contact with the materials being sprayed.

The significantly improved leakage characteristics of the invention permit the use of a double ended paint can similar to the top feed embodiments, to be used upside down for bottom feeding of the spray gun, where the gun and/or the attachment fixtures are suitably modified.

It is therefore an object of the invention to provide a leak proof paint cup assembly or kit for retrofitting an existing paint cup assembly, for use with a top feed spray gun.

It is a further object to provide a practical feed cup with a bottom side opening for filling and cleaning, for use with a bottom feed spray gun.

Still other objects and advantages of the present invention will become readily apparent to those skilled in this art from the following detailed description, wherein I have shown and described only a preferred embodiment of the invention, simply by way of illustration of the best mode contemplated by me on carrying out my invention.

DESCRIPTION OF THE PREFERRED EMBODIMENT

Figure 1:
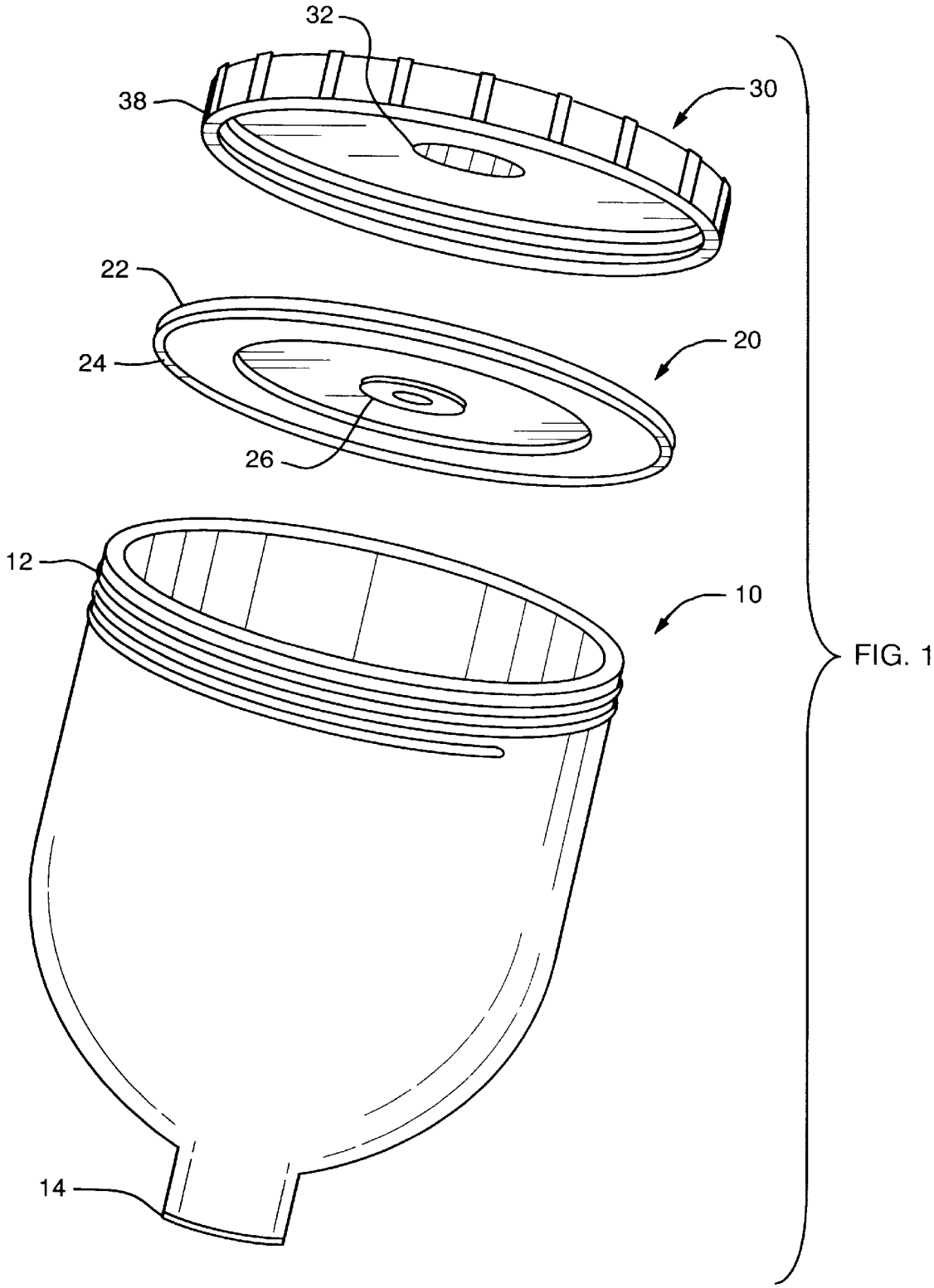
FIG. 1 is an exploded view of the preferred embodiment, illustrating the three basic components.
Figure 2:
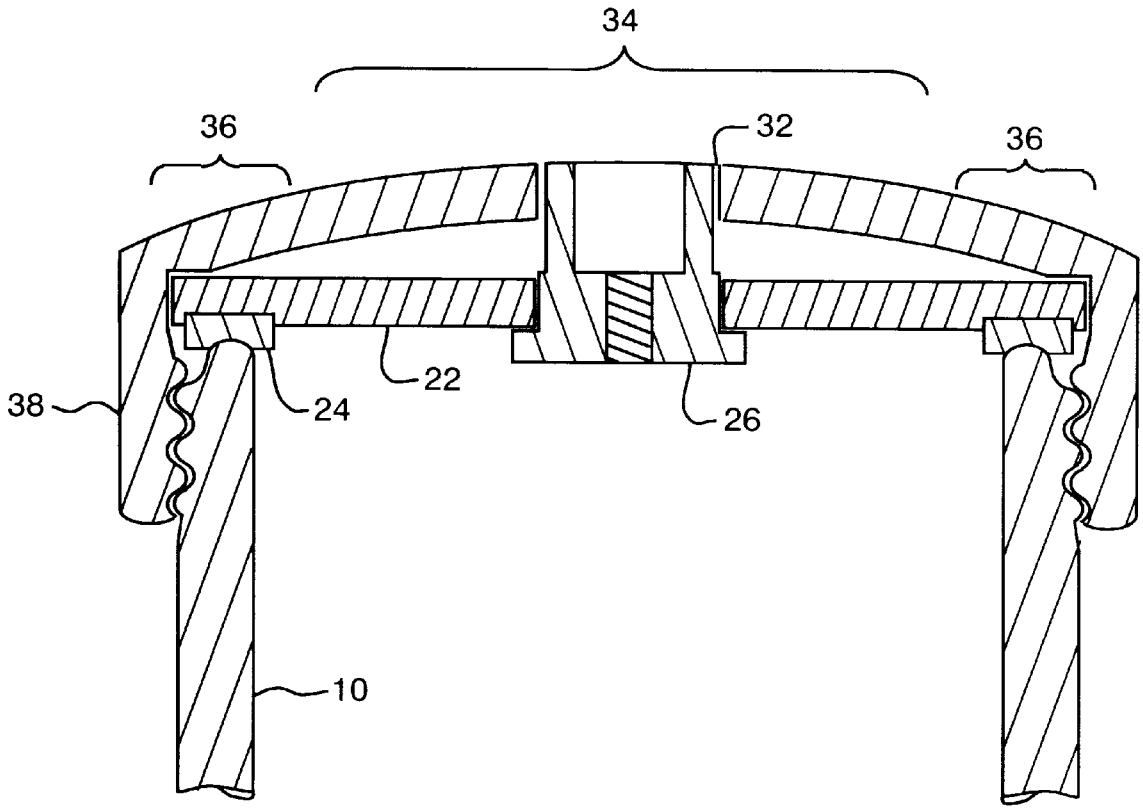
FIG. 2 is a partial cross section view of the embodiment of FIG. 1, assembled, and including an optional external reinforcing strap around the lid flange at the level of the threads.

To those skilled in the art, the invention admits of many variations. An enabling description of the preferred embodiment follows. Referring to FIG. 1, there is shown an exploded view of the preferred embodiment, a top feed cup assembly for a conventional top feed, pressurized spray gun, also useable for gravity or suction systems, illustrating the relationship of the principal components; cup 10, floating gasket plate 20, and threaded lid 30. Referring to FIG. 2, the embodiment of FIG. 1 is shown in partial, cross section, with the addition of an optional reinforcing band 40 on the lid.

Cup 10 is conventional in appearance, molded of strong, light weight, solvent resistant material such as aluminum or a suitable plastic. It is configured with external threads 12 at the top of the cup wall, for rotational attachment to threaded lid 30. There is a smaller threaded outlet fitting 14 at the bottom of cup 10, for attachment and support of the paint can on the spray gun. Fitting 14 provides connection for flow of paint from cup 10 into the spray gun. It will be readily apparent to practitioners of the art that cup 10 may be attached by other means to the spray gun, and that the connection provided by fitting 14, for paint flow to the gun, may be otherwise configured.

Lid 30 is likewise constructed of light weight, solvent resistant material such as aluminum or a suitable plastic. Lid 30 consists of center opening 32, convex or domed center section 34, flat perimeter section 36, and threaded lid flange 38. Referring to FIG. 2, optional external reinforcing band 40 may be applied around lid flange 38, to improve resistance to flange expansion and lid lifting due to the ramp effect of the tapered shoulders of the threads when the cup is pressurized.

Where the cup is supplied to or utilized in applications requiring assurances of a significant pressure rating margin, such as in meeting specific national or international industry standards, it may be necessary to demonstrate pressure testing at up to twice or more of normal working pressures. The common external cup threads are not optimal in this regard, due to lid flange expansion that occurs by shoulder to shoulder ramp action contact between the normally tapered or rounded thread shoulders of the lid and cup when subjected to internal cup pressure. Band 40 or its equivalent reinforcing function may be incorporated into a new lid design, or it be a modification to an existing lid as in a retrofit effort, by cutting a shallow, external groove around the lid flange and adding a strap clamp such as a Oetiker™-type device.

Floating gasket plate 20, consists of an aluminum disk 22, expanded Teflon gasket 24, and aluminum port adapter fitting 26. Disk 22 may be made of stainless steel or other materials suitable for the purpose. Disk 22 is configured on the under side with a circumferential groove the nominal diameter of which is the same as the rim of cup 10. Groove 23 is configured to receive and hold the plate-to-cup sealing gasket 24 with a friction fit, suitable to retain it during assembly, and easily removable for post-painting cleaning. Disk 22 and gasket 24, and other components of the system, whether new or existing, must be made of materials resistant to methylene chloride and other active ingredients of paint solvents and stripping agents.

Port adapter fitting 26, may be made from aluminum, brass, stainless steel, or other materials suitable to the purpose. Fitting 26 provides capability for configuring disk 22 with a vent, pressure feed, or check valve fitting, depending on the type of system operation contemplated. Fitting 26 is installed as a press fit from the underside of disk 22, with a shoulder flange that insures the fitting will be retained in position against internal pressure. The vent, pressure feed or check valve extends through co-axial opening 32 in lid 30 for accessibility when the unit is normally assembled.

In operation, when lid 30 is applied to cup 10, gasket 24 of gasket plate 20 contacts the top edge of the cup wall. As lid 30 is rotatingly engaged with threads 12, gasket plate 20 is drawn into a compressive, full perimeter seal with cup 10, creating a pressure proof chamber within, that is without rotational wear, distortion or damage to the seal.

The fitment of the relatively stiff, flat disk 22 within the slightly convex form of lid 10, distributes the upward pressure exerted from within the cup around the circumference of lid 10, and more particularly, does not apply pressure in the center section of lid 10. This results in an axially upward force on the perimeter of lid 10 that has substantially no moment arm relative to the diameter of the threads. This permits relatively easy retention of gasket plate 20 in place by the threaded interlock between lid and cup, compared to the combination of an upward component of force causing a bending moment from distortion of the lid's center outwards towards the thread joint, which tends to open the seal between the lid and cup of the prior art.

Referring again to FIGS. 1 and 2, there is an inverted version of the invention applicable to a bottom feed spray gun. This variety of the invention includes or assumes a can for a bottom feed spray gun where the can has an upper opening and fittings connectable and functional in the usual fashion with a bottom feed spray gun, and in accordance with the invention, has a removable bottom and gasket plate, the elements of which are directly analogous to those illustrated in FIGS. 1 and 2, except that it need not necessarily include a central adapter fitting or other provision for a vent, pressure inlet, or check valve unless desired by the system designer. This variety of the invention is practical due to the superior sealing characteristics of the floating gasket plate and locking lid of the invention, and permits a simpler, smaller attachment of the cup to the gun, complimented by a large mouth, lower end opening for filling, by turning the gun over, and for cleaning.

As is apparent in this specification and from the claims that follow, various embodiments of the invention may be appear as (1) a floating gasket plate and instructions for modifying an existing lid and paint cup assembly to use it, (2) a kit with a new lid and floating gasket plate which are retrofitable to an existing paint cup, (3) a complete paint cup assembly consisting of a cup, gasket plate and lid, supplied with a paint cup of existing design, (4) a complete paint cup assembly consisting of a cup, gasket plate and lid, supplied with a new cup design complimentary to the requirements of the lid and gasket plate, and (5) a top cup spray gun outfit incorporating any of the previous examples.

As will be realized, these and other embodiments are capable of modifications in various obvious respects, all without departing from the invention. For example, it is within the scope of the invention that the floating gasket plate can be retained by a friction or snap fit within the lid in a slightly loose, easily rotable state and can be easily removed for separate maintenance, modification or cleaning. The compressible gasket material may be of other than expanded Teflon, and may be disposable and replaceable periodically.

The underside of the gasket plate may be configured with a shoulder rather than a groove, so that the gasket is the same diameter of the plate. The inner edge of the gasket shoulder may have a small retaining flange over which the gasket must be slightly deformed to install, but which then holds the gasket in place for assembling the plate and lid to the cup, and then restrains the inner diameter of the gasket from deforming downward when the gasket is compressed.

An acutual rim on the cup is preferred, as the gasket compresses so as to fold somewhat over the rim on both sides, forming an excellent seal. However, instead of the rim described in the preferred embodiment, some cups may have an unsuitable rim, perhaps too thin, but have a suitable inside shoulder at the top of the cup, with a "flat" or planar upward facing surface of sufficient width to provide a seat for the gasket and gasket plate. Of course, the lid must be pressing on only the gasket plate, so if the shoulder is recessed below the rim more than the thickness of the gasket plate, a shim or the like may be necessary between the gasket plate and the lid. Here and in the claims, the references to the rim of the cup should be interpreted to include in these cases, an inside shoulder at the top of the cup.

As another example of the invention, there is a leak resistant, pressure proof, feed cup assembly for a top feed spray gun consisting of a feed cup, a domed lid, and a flat gasket plate. The gasket plate has a center section and a periphery, and the center section is configured for attaching a vent, pressure feed or check valve fitting. The cup has a lower end configured for attachment to the feed port of the spray gun and an upper end with a cup rim upon which the gasket plate can bear. The gasket plate has an underside gasket configured for a uniform fit suitable for making a vertically compressive sealing contact with the cup rim or shoulder flat when it is centered on the cup.

The lid is sized to cover the gasket plate and shaped for uniformly contacting the top side of the gasket plate around its periphery and domed so as to not contact the gasket plate anywhere in its center section. The lid and the cup each having respective mating structures, such as threads, clamps or latches, by which the lid may be placed in compressive locking attachment to the cup with the gasket plate interspersed under compression between the cup and the lid. The lid has a hole closely configured for clearance of and access to whatever such vent, pressure feed or check valve fitting might be attached to the gasket plate.

There are other aspects and variations to the preceding and other embodiments, such as a gasket plate consisting of an aluminum disk with an underside groove for accepting and holding the gasket in position during assembly; an adapter fitting mounted in the center of the disk that is suitable for attaching a vent, pressure feed or check valve fitting; and a cup with external threads and a domed lid with a rimmed flange with internal threads that will mate with the cup threads for rotationally advancing attachment, or screwing on of the lid, to the cup. The gasket plate is held stationary with respect to the cup by friction between the rim and the gasket while the lid is rotating during the screw-on attachment.

Additional variations include a rimmed flange on the lid that incorporates or is modified to add an external reinforcing band or strap clamp to resist expansion of the rimmed flange under the lifting pressure of the gasket plate; and a gasket plate configured with a centrally mounted outflow check valve.

As yet another example of the invention, there is a floating gasket plate kit for use with a feed cup and domed lid of a top feed spray gun where the cup has external threads and a rim at the upper end upon which the gasket plate can be positioned for sealing. The lid has a rimmed flange with mating internal threads for being screwed on to the cup, and has or can be modified to have a center access hole for clearance of a centrally mounted through fitting in the gasket plate, that consists of a flat disk with a groove on the underside for attaching a compressible gasket, and a gasket sized to mate uniformly with the rim of the cup when it is centered on the cup. There is such a kit that also includes a strap clamp for reinforcing the rimmed flange of the lid. There is likewise a kit that includes instructions for modifying the lid to remove all existing fittings, making or insuring the presence of a clearance hole for the adapter fitting in the gasket plate, and adding a strap clamp to the lid flange.

As additional examples of the invention, there is a floating gasket plate and lid assembly kit for retrofit to a feed cup for a top feed spray gun where the cup has external threads and a rim or flat at the upper end, consisting of various components and combinations of the previously described embodiments. There is also a gasket plate, lid and cup collar assembly for a cup with an outwardly rolled rim, such as are common to metal cups. In these cases, a simple cup collar with external threads is sized to fit snuggly around the cup from the lower end. It is configured with a shoulder that will abutt the rolled rim at the upper end of the cup; the rolled rim providing a stop beyond which the collar cannot be pulled. The lid is then screwed to the collar with the gasket plate In summary, the invention is distinguished from the prior art by incorporating a floating gasket plate that provides a non-rotating sealing mechanism within a rotating lid, and distributes internal pressure to the circumference of the lid, avoiding deformation or "oil canning" of the center section of the lid. This prevents the leakage common to the lids and cups of the prior art.

The figures are illustrative of preferred embodiments but not exhaustive of the scope of the invention, as is readily apparent from the description and the following claims.

I claim:

1. A leak resistant pressure proof feed cup assembly for a top feed spray gun comprising:

a feed cup, a domed lid, and a flat gasket plate, said gasket plate having a center section and a periphery, said center section configured for attaching a vent, pressure feed or check valve fitting, said cup having a lower end configured for attachment to the feed port of said spray gun and an upper end having a cup rim, said gasket plate having an underside gasket configured for uniform fit and vertically compressive sealing contact with said cup rim when centered there on, said lid sized to cover said gasket plate and shaped for contacting the top side of said gasket plate about its said periphery and not contacting said gasket plate at its said center section, said lid and said cup each having respective mating structures by which said lid may be placed in compressive locking attachment to said cup with said gasket plate interspersed under compression there between, said lid having a hole configured for clearance of and access to such said vent, pressure feed or check valve fitting as may be attached to said gasket plate, said respective mating structures comprising said cup configured with external threads and said domed lid configured with a rimmed flange with mating internal threads for rotationally advancing attachment to said cup, said gasket plate being held stationary with respect to said cup by friction between said rim and said gasket while said lid is rotating during said attachment, said rimmed flange configured with an external reinforcing band.

2. A feed cup assembly for a top feed spray gun according to claim 1, said reinforcing band comprising a strap clamp.

3. A feed cup assembly for a top feed spray gun according to claim 1, said gasket plate comprising an aluminum disk with an underside groove for accepting said gasket.

4. A feed cup assembly for a top feed spray gun according to claim 3, comprising an adapter fitting suitable for said attaching a vent, pressure feed or check valve fitting, said adapter fitting mounted in the center of said disk.

5. A feed cup assembly for a top feed spray gun according to claim 1, said gasket plate comprising a stainless steel disk with an underside groove for accepting said gasket.

* * * * *